US005454404A

United States Patent [19]

Okawa

[11] Patent Number: 5,454,404

[45] Date of Patent: Oct. 3, 1995

[54] WEAVE STRUCTURE FOR PREVENTING WOVEN TAPE SELVEDGE FROM FRAYING

[75] Inventor: Mitsuhisa Okawa, Toyama, Japan

[73] Assignee: Yoshida Kogyo K.K., Tokyo, Japan

[21] Appl. No.: 213,062

[22] Filed: Mar. 15, 1994

[30] Foreign Application Priority Data

Mar. 16, 1993 [JP] Japan ..... 5-011501 U

[51] Int. Cl.[6] ..... D03D 1/00; D03D 5/00; D03D 19/00; D03D 27/00

[52] U.S. Cl. ..... 139/54; 139/430

[58] Field of Search ..... 139/54, 430, 383 R

[56] References Cited

U.S. PATENT DOCUMENTS

| | | | |
|---|---|---|---|
| 3,078,654 | 2/1963 | Marshall | 57/163 |
| 3,540,204 | 11/1970 | Tanaka et al. | 57/163 |
| 4,499,842 | 2/1985 | Mahr | 139/383 R X |
| 4,830,401 | 5/1989 | Honda | 280/736 |
| 5,131,434 | 7/1992 | Krummheuer et al. | 139/383 R X |
| 5,141,787 | 8/1992 | Yamamoto | 280/728 |
| 5,213,363 | 5/1993 | Fukumori et al. | 280/743 |
| 5,236,775 | 8/1993 | Swoboda et al. | 139/389 X |

FOREIGN PATENT DOCUMENTS

| | | |
|---|---|---|
| 1525044 | 5/1968 | France . |
| 611709 | 11/1948 | United Kingdom . |
| 639715 | 7/1950 | United Kingdom . |
| 755090 | 8/1956 | United Kingdom . |
| 995536 | 6/1965 | United Kingdom . |
| 1013176 | 12/1965 | United Kingdom . |
| 1056748 | 1/1967 | United Kingdom . |
| 1341281 | 12/1973 | United Kingdom . |
| 1349783 | 4/1974 | United Kingdom . |

*Primary Examiner*—Andrew M. Falik
*Attorney, Agent, or Firm*—Hill, Steadman & Simpson

[57] ABSTRACT

A woven structure for preventing selvedges of a woven tape with a back surface covered by a coating of synthetic resin from fraying, wherein at least the cut portion of the woven tape, which is obtained by cutting a large-width woven fabric longitudinally along its width, has an interlaced woven structure along a predetermined width.

4 Claims, 3 Drawing Sheets

WEAVE STRUCTURE FOR PREVENTING WOVEN TAPE SELVEDGE FROM FRAYING

BACKGROUND OF THE INVENTION

1. Field of the Invention

This invention relates to a woven structure for preventing from fraying, the selvedges of a surface fastener tape having a multiplicity of piles or hooks on the woven surface, or the selvedges of a small-width tape to be used for a water-resisting tape with a back surface covered by a coating. More particularly, the invention relates to a woven structure for preventing from fraying, warp yarns of the selvedges of a predetermined-width tape to be obtained from a large-width woven fabric by cutting.

2. Description of the Related Art

In manufacturing a woven tape having a predetermined width, a narrow-width loom such as a needle weaving machine is used in which a weft yarn is inserted into the shed of warp yarns by reciprocatingly moving a carrier and a selvedge is formed by knitting.

However, as the purposes for their uses increase, different widths of woven tapes are increasingly being required for surface fastener tapes or water-resistant tapes. There is a limit in increasing the manufacturing speed of the narrow-width loom, and especially since a special narrow-width loom such as the needle weaving machine has a complex structure, it has already been close to the limit in view of cost.

Attempts have been made to realize a special narrow-width loom which can meet with requirements for various sizes of woven tapes, and is excellent in manufacturing ability and reduces the manufacturing cost. To this end, it is known to weave a large-width cloth using an ordinary large-width loom, coat synthetic resin over the back surface of the woven cloth, and cut the coated woven cloth into woven tapes of a predetermined width. This simple back coating is not enough to prevent warp yarns of the cut edges of the woven tapes from fraying. Consequently, cutting is performed usually by heating or ultrasonic waves to fuse the cut edges of the woven tapes so as to surely prevent fraying of warp yarns.

In the case of a woven tape, it is unlikely that only the cut portion has a Special woven structure different from a foundation having an ordinary woven structure. Or in the case of a loop woven cloth, such as a surface fastener having a multiplicity of piles or hooks, it has been customary to form the cut portion into a flat surface and to use a basic structure such as a plain weave for the woven structure of the flat surface as disclosed in, for example, Japanese Utility Model Laid-Open Publication No. SHO 62-139304.

However, in the case where the cut portion of a large-width woven cloth has an ordinary woven structure, the criss-cross of warp yarns of the cut portion is perpendicular to the plane of weaving, irrespective of whether the back surface is coated and the cut edges are fused. Therefore, synthetic resin coating over the back surface would hardly penetrate into the woven structure and would hardly stay in the crisscross portion of warp yarns so that warp yarns of the cut portion tends to be broken by a sewing needle when the surface fastener is sewn to a companion part and so that the fused portion of the cut edges would be worn away as washing is repeated several times, causing fraying of warp yarns.

The concept of fusing piles or hooks, which are standing on the surface, with the foundation by flattening the cut portion under ultrasonic heat and pressTe in order to prevent fraying of warp yarns is disosed in, for example, Japanese Patent Laid-Open Publication No. HEI 5-42009. According to this method, although fraying of warp yarns can be prevented, the cut portion tends to become hard so that the texture of the foundation woven cloth might be impaired.

SUMMARY OF THE INVENTION

It is therefore an object of a woven structure, for preventing selvedges of a woven tape from fraying, with which structure warp yarns scarcely fray and coating material can penetrate into the back surface and criss-crossing warp yarns can be welded together stably and woven tapes can be obtained from a large-width woven cloth without impairing the texture of cut portions and fraying of warp yarns.

According to this invention, there is provided a woven structure for preventing warp yarns of end edges of a woven tape which is obtained from a large-width woven fabric, with a back surface covered by a coating of synthetic resin, by cutting transversely, wherein the cut portion of the woven tape has an interlaced woven structure along a predetermined width.

Because of this interlaced woven structure, it would become different in weaving density where some of the warp yarns constituting the foundation structure cross the interlacing yarns in a plane parallel to the plane of weaving, so that the interyarn gap ratio of the woven fabric surface would increase and synthetic resin coating material would tend to penetrate into the woven structure to reliably stick to the crossings of part of the warp yarns and interlacing yarns.

From a woven fabric structure view point, therefore, when the warp yarns and interlacing yarns are about to move in the weft direction, the warp yarns are firmly tightened by the interlacing yarns and, as a result, these warp yarns firmly grip the weft yarns so as not to be easily removed from the weft yarns. Simultaneously, at more areas the warp yarns themselves are firmly attached to one another and, as a result, the gripping force of the weft yarns would increase to prevent the warp yarns much more effectively from being removed from the weft yarns.

DETAILED DESCRIPTION

Figure 3:
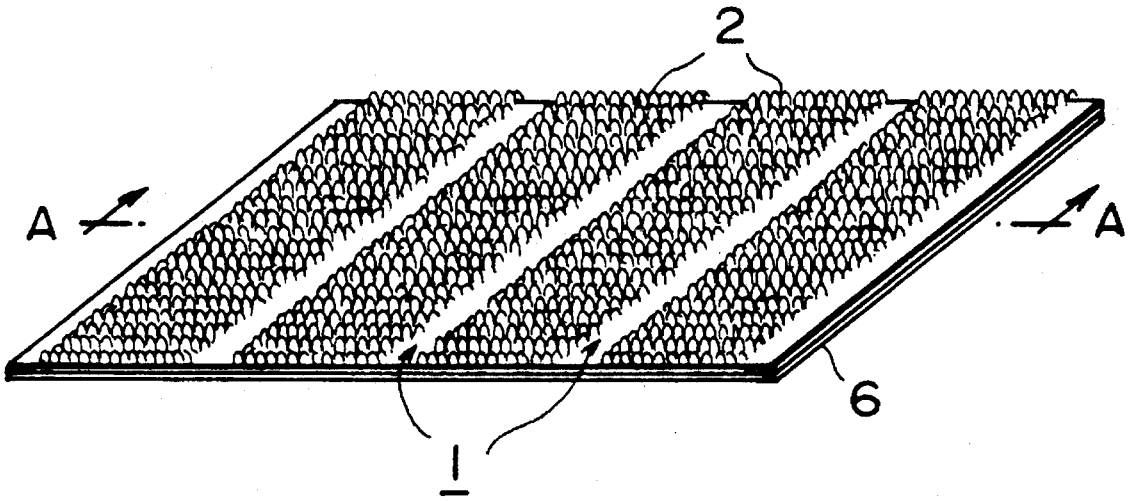
FIG. 3 is a perspective view showing one example of large-width woven fabric from which female surface fastener tapes are to be formed.
Figure 4:
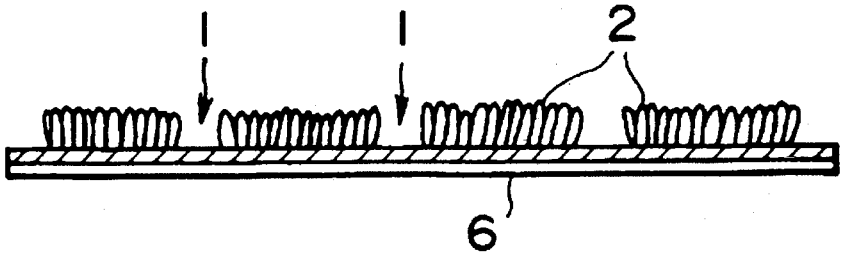
FIG. 4 is a cross-sectional view taken along line A—A of FIG. 3.

The typical embodiments of this inventLion will now be described in detail. In the embodiments, the structure for preventing fraying of warp yarns is applied in a large-width woven fabric from which female surface fastener tapes, which are woven so as to have a multiplicity of piles 2 between a number of ribs 1 on the front surface as shown in FIGS. 3 and 4, are to be manufactured. This invention should by no means be limited to female surface fastener tapes and may be applied not only to male surface fastener tapes, which have a number of hooks on the front surface, but also to ordinary woven tapes with the back surfaces coated.

For manufacturing female surface fastener tapes from the large-width woven fabric, firstly the back surface of the woven fabric is covered with a coating 6 of thermoplastic resin such as polyester and polyurethane, and then the resulting woven fabric is cut such as by heating or ultrasonic waves along the center of each rib portion 1. As a result, female tapes having a predetermined width. Accordingly the rib portion 1 should be regarded as the cut portion (edge).

Figure 1:
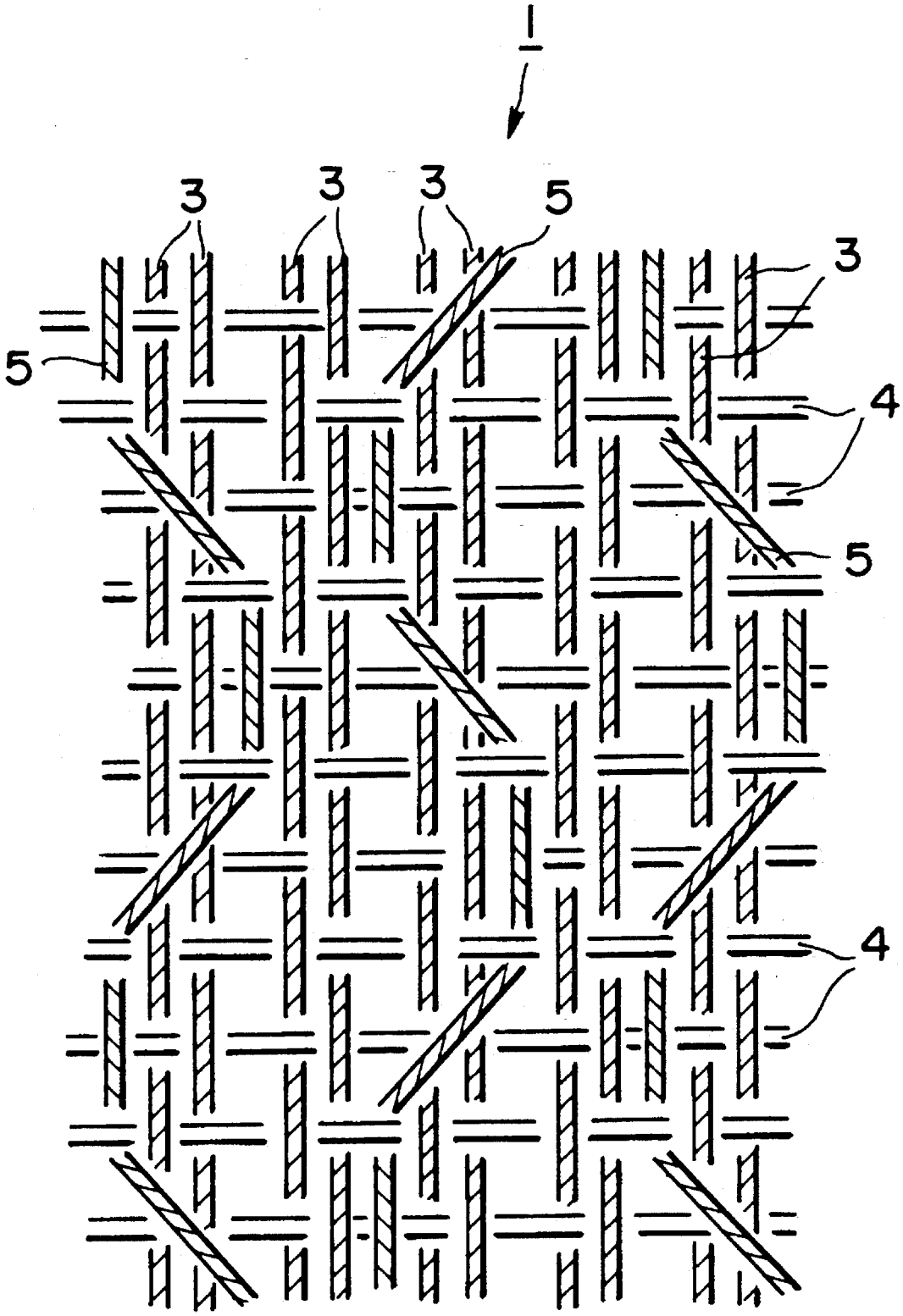
FIG. 1 is a plan view of a woven structure of a prospective cut portion of a woven fabric, along which portion the woven fabric is to be cut to form a tape, according to a typical embodiment of this invention.

FIG. 1 is a plan view showing a preferred example of the woven structure at the rib portion or cut portion 1. The woven fabric has a plain weave structure of warp yarns 3 and weft yarns 4; two of the warp yarns 3 are interlaced with interlacing yarns 5, the next two warp yarns 3 are skipped, and the further next two warp yarns 3 are interlaced with interlacing yarns 5, and the same pattern is repeated to make a weave structure of the entire cut portion 1. In the example of FIG. 1, the interlacing portions of the interlacing yarns 5 are arranged in a staggered pattern warpwise so that the interlacing portions of the adjacent interlacing yarns 5 cannot overlap one another in the weftwise direction.

With this woven structure, as is understood from FIG. 1, the weave density would be different locally, and part of warp yarns 3 would cross the interlacing yarns 5 in a plane parallel to the plane of weaving. In other words, the gap ratio of the woven fabric surface would increase and, at the same time, synthetic resin material for coating would easily penetrate into the woven structure to reach the planar crossings of part of warp yarns 3 and interlacing yarns 5 at an increasing rate.

From a woven fabric structure view point, therefore, when the warp yarns 3 and interlacing yarns 5 are about to move in the direction of the weft yarns 4. Two warp yarns 3 are firmly tightened by the interlacing yarns 5 and, as a result, these warp yarns 3 firmly grip the weft yarns 4 so as not to be easily removed from the weft yarns 4. Simultaneously, at more areas the warp yarns themselves are firmly attached to one another and, as a result, the gripping force of the weft yarns 4 would increase to prevent the warp yarns 3 much more effectively from being removed from the weft yarns 4.

Figure 2:
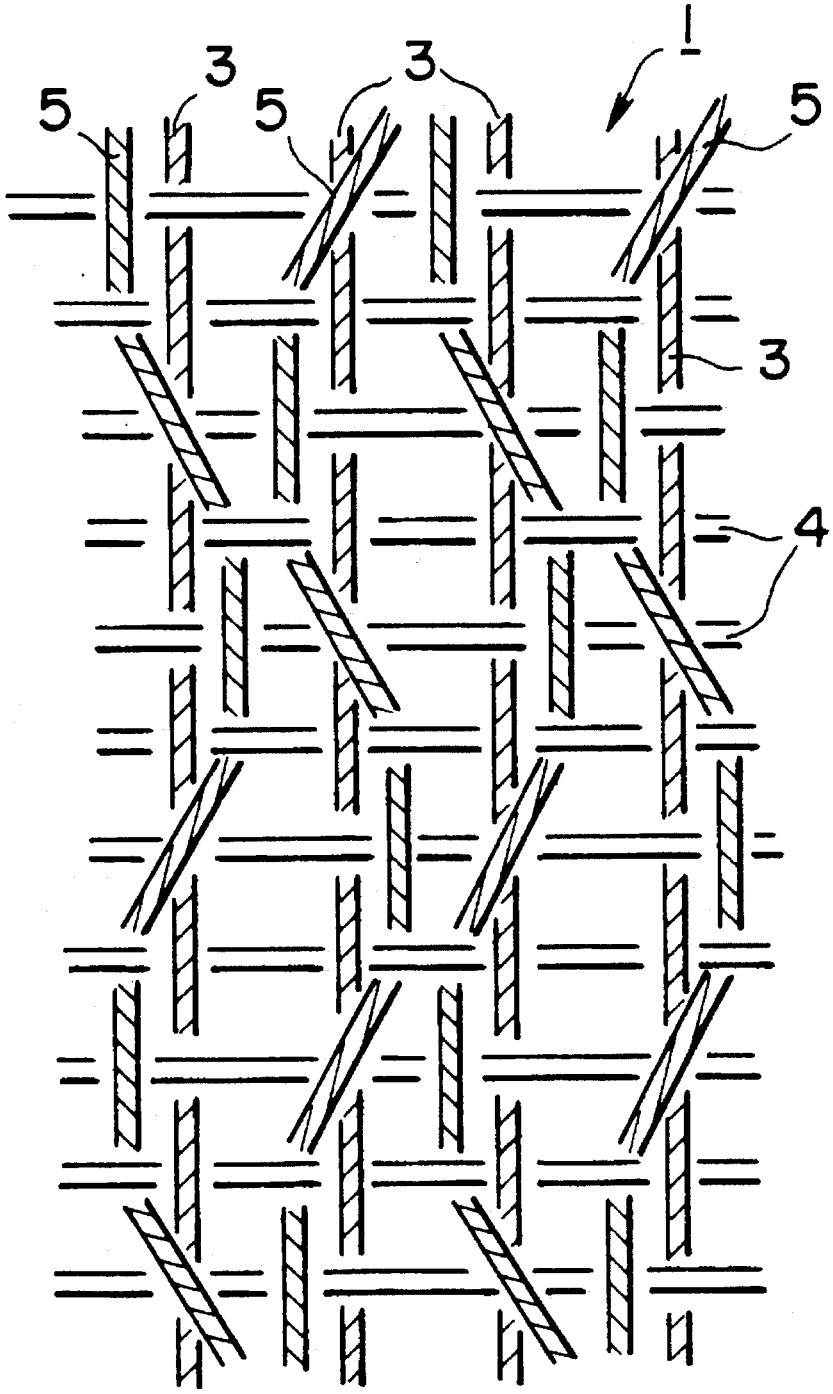
FIG. 2 is a plan view of a modified woven structure of a prospective cut portion of a woven fabric, along which portion the woven fabric is to be cut to form a tape, according to another embodiment of the invention.

FIG. 2 is a plan view showing a simplest example of the woven structure at the cut portion 1. This woven fabric has a plain weave structure of warp yarns 3 and weft yarns 4 like the previous example; every warp yarn 3 is interlaced with a single interlacing yarn 5, and the interlacing portions of the interlacing yarns 5 are arranged in a staggered pattern warpwise so that the interlacing portions of the adjacent interlacing yarns 5 cannot overlap one another in the direction of weft yarns 4.

Even the woven structure of FIG. 2 can perform the above-mentioned function adequately; however, if its denier is small and/or if fraying of warp yarns are to be prevented, the structure of FIG. 1 is preferred or the number of warp yarns 3 with which interlacing yarns are to be interlaced is preferably more than two.

As is apparent from the foregoing description, according to this invention, since a large-width woven fabric whose back surface is covered with a coating is cut into small-width woven tapes so as to have interlaced structure of a suitable width along the individual cut portion, the weave density of the cut portion varies locally, and part of warp yarns crosses interlacing yarns in a plane parallel to the plane of weaving so that the gap ratio of the woven fabric surface would increase and, at the same time, synthetic resin for coating would easily penetrate into the woven structure to reach the planar crossings of part of warp yarns and interlacing yarns, thus causing an increased degree of adhesion between these yarns. Therefore, even if the warp yarns and interlacing yarns tend to be removed from the weft yarns, the warp yarns Will be firmly tightened by the interlacing yarns so that the weft yarns are firmly gripped by the warp yarns and the interlacing yarns, thus preventing the warp yarns and the interlacing yarns from being removed from the weft yarns and causing an increased degree of adhesion between the warp yarns and interlacing yarns. Additionally, since the weft yarns are gripped by the warp yarns with increased firmness to prevent the warp yarns from being removed from the weft yarns, the selvedges of the tapes would be quite free from fraying.

What is claimed is:

1. A woven structure for preventing selvedges of a woven tape from fraying, said structure having a back surface covered by a coating of synthetic resin, wherein at least a plurality of cut portions of said woven tape are adapted to be cut to separate the woven structure into smaller structures, which is obtained by cutting a large-width woven fabric longitudinally along its width at the cut portions, and each cut portion has an interlaced woven structure along a predetermined width thereof, said interlaced woven structure comprising a plurality of warp yarns and weft yarns in a plain weave and interlacing yarns extending along the warp yarns and interlaced with at least one of the warp yarns, the interlacing yarns crossing said warp yarns at a plurality of locations along the length of said warp yarn in a plane parallel to the plane of weaving.

2. A woven structure according to claim 1, comprising:

a woven foundation structure having a plurality of fastener element regions extending longitudinally and alternating with said cut portions; and a plurality of fastener elements arranged on the fastener element regions, said fastener elements extending from said structure.

3. The structure according to claim 2, wherein said cut portions are devoid of fastener elements.

4. The structure according to claim 2, wherein said foundation structure in said pile regions have an ordinary weave without interlacing.

* * * * *